US008979062B2

(12) United States Patent
Yadav

(10) Patent No.: US 8,979,062 B2
(45) Date of Patent: Mar. 17, 2015

(54) SECONDARY ACTIVATION OF PACKER AND METHOD

(75) Inventor: Seemant Yadav, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 600 days.

(21) Appl. No.: 13/192,891

(22) Filed: Jul. 28, 2011

(65) Prior Publication Data

US 2013/0025689 A1 Jan. 31, 2013

(51) Int. Cl.
*E21B 33/06* (2006.01)

(52) U.S. Cl.
CPC ..... *E21B 33/062* (2013.01)
USPC ..... 251/1.3; 251/172; 251/175; 251/190; 277/325; 166/84.4

(58) Field of Classification Search
CPC ..... E21B 33/06; E21B 33/061; E21B 33/062
USPC ..... 251/1.1–1.3, 172, 175, 190, 191; 277/324, 325, 327, 337, 338; 166/84.4, 166/85.4
See application file for complete search history.

(56) References Cited

U.S. PATENT DOCUMENTS

| | | | | | |
|---|---|---|---|---|---|
| 2,690,320 | A * | 9/1954 | Shaffer et al. | ..... | 251/1.3 |
| 2,850,256 | A * | 9/1958 | Bolling, Jr. et al. | ..... | 251/1.3 |
| 3,036,807 | A * | 5/1962 | Lucky et al. | ..... | 251/1.3 |
| 3,102,709 | A * | 9/1963 | Allen | ..... | 251/1.3 |
| 3,670,761 | A * | 6/1972 | Lerouax | ..... | 251/1.3 |
| 4,265,424 | A * | 5/1981 | Jones | ..... | 251/1.3 |
| 4,943,031 | A * | 7/1990 | Van Winkle | ..... | 251/1.3 |
| 5,199,683 | A * | 4/1993 | Le | ..... | 251/1.3 |
| 6,974,135 | B2 * | 12/2005 | Melancon et al. | ..... | 251/1.2 |

* cited by examiner

*Primary Examiner* — Eric Keasel
(74) *Attorney, Agent, or Firm* — Bracewell & Giuliani LLP

(57) ABSTRACT

Method, ram block and ram blowout preventer (BOP) for sealing a well. The BOP includes a body having a first chamber extending along a first direction and a second chamber extending along a second direction, substantially perpendicular to the first direction; a ram block configured to move inside the first chamber, the ram block having a packer region and at least one channel that extends all the way through the ram block; a packer configured to be provided in the packer region to seal a tool provided inside the second chamber; and at least one double piston provided through the at least one channel so that a pressure from the well is transmitted to the packer.

16 Claims, 10 Drawing Sheets

SECONDARY ACTIVATION OF PACKER AND METHOD

BACKGROUND

1. Technical Field

Embodiments of the subject matter disclosed herein generally relate to methods and devices and, more particularly, to mechanisms and techniques for increasing a pressure applied to a ram blowout preventer (BOP) for sealing a wellbore.

2. Discussion of the Background

One apparatus for sealing a well is the ram BOP. The ram BOP (herein simply BOP) is a safety mechanism that is used at a wellhead of an oil or gas well. The BOP may be used for offshore drilling and also for land-based drilling. The BOP is configured to shut the flow from the well when certain events occur. One such event may be the uncontrolled flow of gas, oil or other well fluids (e.g., mud) from an underground formation into the well. Such event is sometimes referred to as a "kick" or a "blowout" and may occur when formation pressure exceeds the pressure generated by the column of drilling fluid. This event is unforeseeable and if no measures are taken to prevent and/or control it, the well and/or the associated equipment may be damaged.

The BOP may be installed on top of the well to seal the well in case that one of the above events is threatening the integrity of the well. The BOP is conventionally configured to prevent the release of pressure either in the annular space between the casing and the drill pipe or in the open hole (i.e., hole with no drill pipe) during drilling or completion operations.

In this regard, the BOP has two ram blocks that are configured to move towards each other or away from each other as desired by the operator of the rig. The operator of the rig controls the closing and opening of the ram blocks by activating various valves that control a hydraulic fluid. The hydraulic fluid is either provided from accumulators provided next to the BOP (e.g., undersea for an undersea BOP) or through pipes from the surface. By allowing the hydraulic fluid under pressure to enter a closing chamber the ram blocks are closed and by allowing the hydraulic fluid to enter an opening chamber the ram blocks are opened.

The ram blocks have at their frontal faces an elastomeric material, a packer, that has a semi-spherical profile. Thus, when the drill line is still inside (i.e., crossing the BOP) and there is a need to close the well, the ram blocks close around the drill line and the profile of the packers ensure that an interface between the drill line and the ram blocks is sealed. It is noted that shearing ram blocks have cutting edges instead of packers and when there is a need to close the BOP, the shearing ram blocks will close the well by severing the drill line.

However, in practice it is noted that sometimes the interface between the packers and the drill line is not completely sealed, i.e., there is a leakage of mud or other fluids that are present in the well. The leak is more serious as the diameter of the drill line increases. Thus, there is a need in the industry to provide a better sealing when a ram block with a packer is used to close a well while a tool is still inside the BOP.

Accordingly, it would be desirable to provide systems and methods that achieve the sealing of the well irrespective of the diameter of the drill line and to avoid the above noted shortcomings.

SUMMARY

According to one exemplary embodiment, there is a ram blowout preventer (BOP) for sealing a well. The ram blowout preventer includes a body having a first chamber extending along a first direction and a second chamber extending along a second direction, substantially perpendicular to the first direction; a ram block configured to move inside the first chamber, the ram block having a packer region and at least one channel that extends all the way through the ram block; a packer configured to be provided in the packer region to seal a tool provided inside the second chamber; and at least one double piston provided through the at least one channel so that a pressure from the well is transmitted to the packer.

According to another exemplary embodiment, there is a ram block configured to move inside a first chamber of a ram blowout preventer (BOP). The ram block includes a packer region and at least one channel that extends all the way through the ram block; a packer configured to be provided in the packer region to seal a tool provided inside a second chamber of the BOP; and at least one double piston provided through the at least one channel so that a pressure from a well to which the BOP is attached is directly transmitted to the packer.

According to still another exemplary embodiment, there is a method for manufacturing a ram block for a ram blowout preventer. The method includes providing a ram block; forming a packer region in the ram block; forming at least one channel that extends all the way through the ram block; installing at least one double piston through the at least one channel; and installing a packer in the packer region so that a first piston side of the double piston contacts the packer when pressure is applied on a second piston side of the double piston.

According to yet another exemplary embodiment, there is a method of operating a ram blowout preventer (BOP) for sealing a well. The method includes activating a primary system for closing a ram block to seal with a packer a tool provided in the BOP; and applying well pressure on a double piston provided through at least one channel of the ram block so that a first piston side of the double piston directly applies a corresponding force on the packer.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a ram BOP. However, the embodiments to be discussed next are not limited to these systems, but may be applied to other systems, i.e., a gate valve.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a ram BOP is configured to have ram blocks provided with at least one through-channel that accommodates a corresponding double piston. The double piston has a first face exposed to a fluid that is present in a wellbore and a second face that contacts a packer of the ram block. The pressure from the wellbore is exerted on the packer for a better sealing of a tool present in the BOP.

Figure 1:
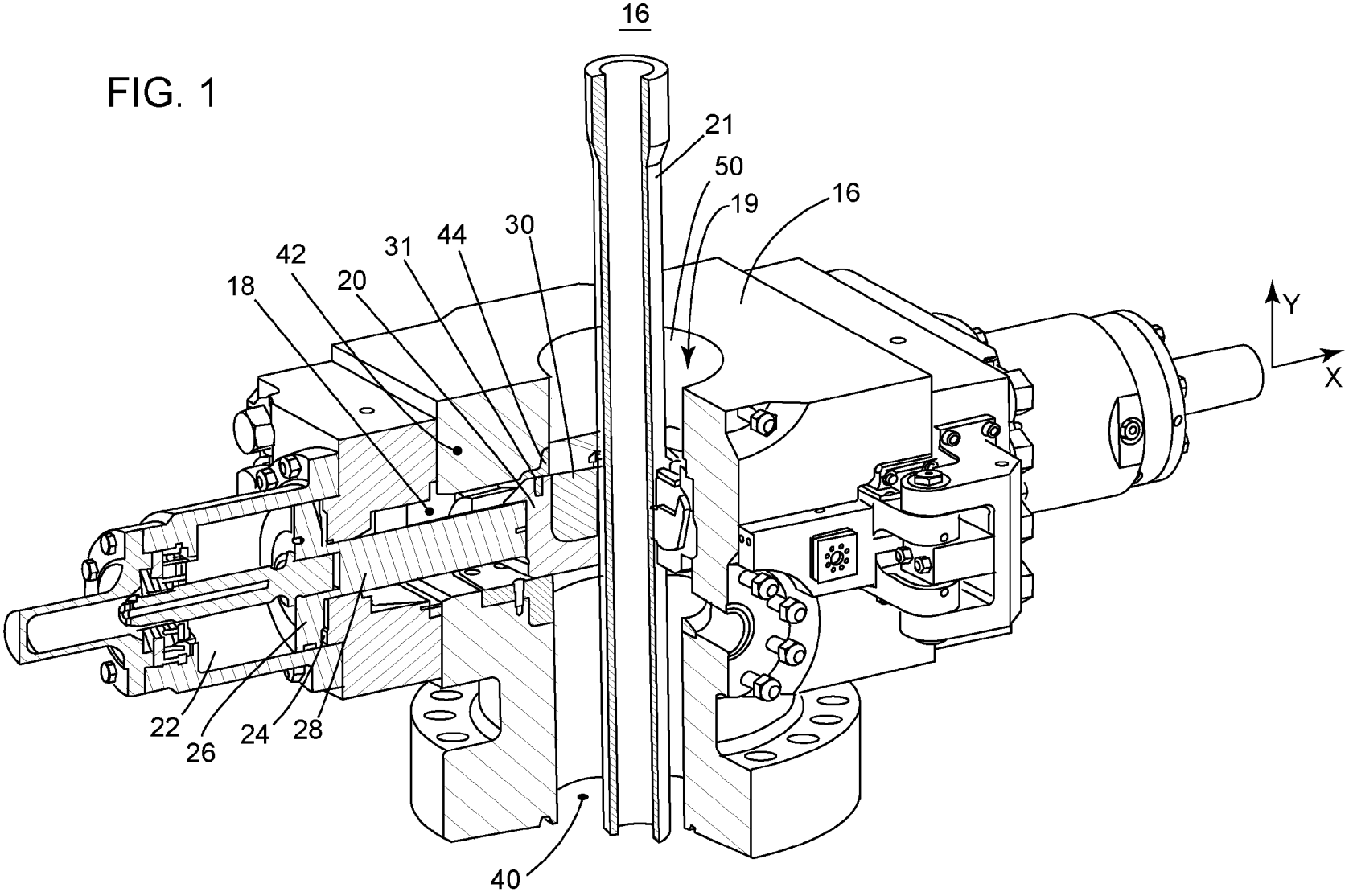
FIG. 1 is a schematic diagram illustrating a BOP with novel ram blocks according to an exemplary embodiment.

Novel features of this ram BOP are now discussed with regard to the figures. FIG. 1 illustrates a cut view of a BOP 16. The BOP 16 has ram blocks 20 configured to move along a longitudinal first chamber 18. A second chamber 19, substantially perpendicular on the first chamber 18, is configured to accommodate a tool 21, e.g., a drill line. The term "substantially" here means that even if the direction of the first chamber makes an angle in the range of 85 to 95 degrees with the direction of the second chamber, the two chambers are still considered perpendicular. Thus, the second chamber 19 is open while the first chamber 18 is closed. The ram blocks 20 are shown closed on the tool 21 inside the first chamber 18.

A primary activation mechanism for the ram blocks 20 includes a closing chamber 22 and an opening chamber 24 (having a substantially zero volume when the ram blocks are closed as in FIG. 1). A piston 26 is provided between the closing chamber 22 and the opening chamber 24. A rod 28 is attached to the piston 26 and is also configured to connect to the ram block 20. Thus, when pressure in the closing chamber 22 overcomes the pressure in the opening chamber 24, the piston 24 moves to left in FIG. 1, closing the ram block 20 (i.e., pressing the ram block on the drill line 21). This is the primary system for applying pressure on the ram blocks and on the packers. A packer 30 is shown on a frontal face of the ram block 20. The packer 30 contacts the drill line 21 for a better seal.

When a pressure in the wellbore 40 needs to be controlled, the ram blocks 20 are closed. The increasing pressure in the wellbore 40 determines the ram blocks 20 to be pressed upward, i.e., along a Z direction in FIG. 1. A seal 31 is provided on an upper part of the ram block 20 to achieve a seal between the ram block 20 and a body 42 of the ram BOP 16. A further seal 44 may be provided to further increase the seal between the ram block and the body of the BOP. This means that a fluid present in the wellbore 40, e.g., mud, may enter the first chamber 18 but should not be able to pass past the packer 30 into a first region 50 of the second chamber 19.

Figure 2:
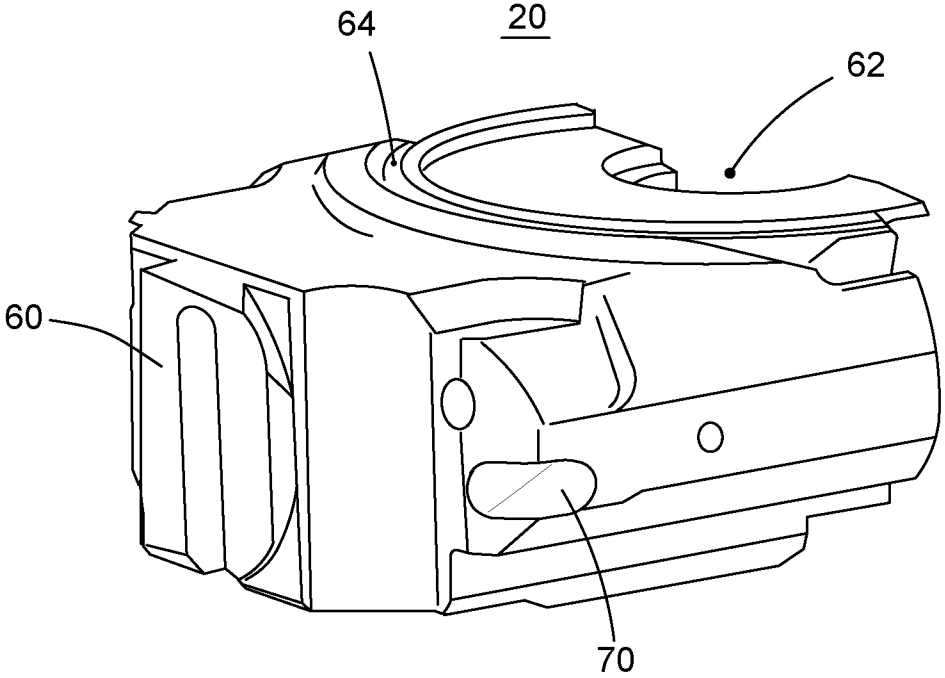
FIG. 2 is a schematic diagram of a back view of a ram block according to an exemplary embodiment.

The pressure of the wellbore that is present in the first chamber 18 may be used to apply further pressure on the packer 30 as discussed now with regard to FIG. 2. FIG. 2 shows a side back view of a ram block 20. The ram block 20 has a back portion 60 that is configured to connect to the rod 28 and a frontal portion 62 that is configured to hold the packer 30. The frontal portion 62 is configured to face the drill line 21 when the ram blocks 20 are closed. FIG. 2 also illustrates a groove 64 that is configured to accommodate seal 31 for achieving the seal between the body 42 of the ram BOP and the ram block 20.

A channel 70 is illustrated in FIG. 2 on the side of the ram block 20. The channel 70 passes all the way through the ram block 20, i.e., from a side that communicates with the first chamber 18 to a side that communicates with the packer 30. One or more such channels 70 may be formed in each ram block 20, depending on the type of ram block, its geometry, and the available space.

Figure 3:
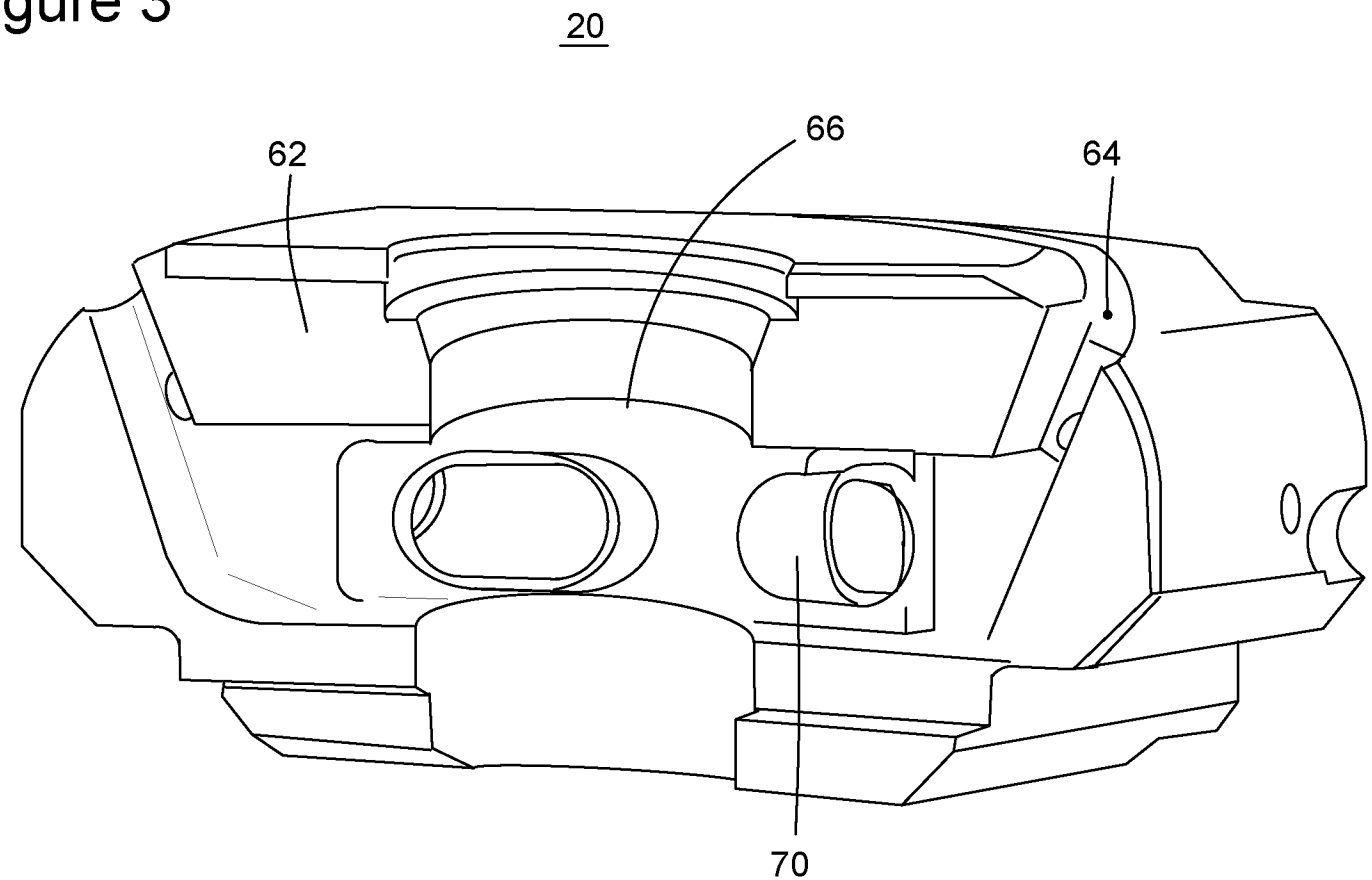
FIG. 3 is a front view of a ram block according to an exemplary embodiment.
Figure 4:
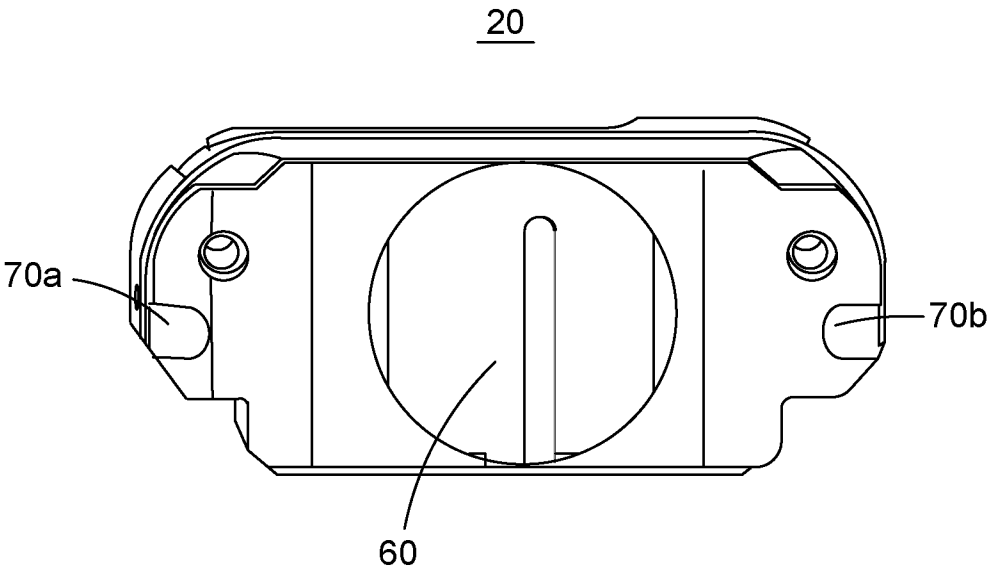
FIG. 4 is a back view of a ram block having two channels according to an exemplary embodiment.

FIG. 3 is a front view of the ram block 20 and shows the other end of the channel 70. FIG. 3 also shows a packer region 66 that is configured to receive the packer 30. FIG. 4 is a back view of the ram block 20 and illustrates an embodiment in which there are two channels 70 per ram block 20. Each channel 70 is configured to accommodate a double piston 80 as shown in FIG. 5.

Figure 5:
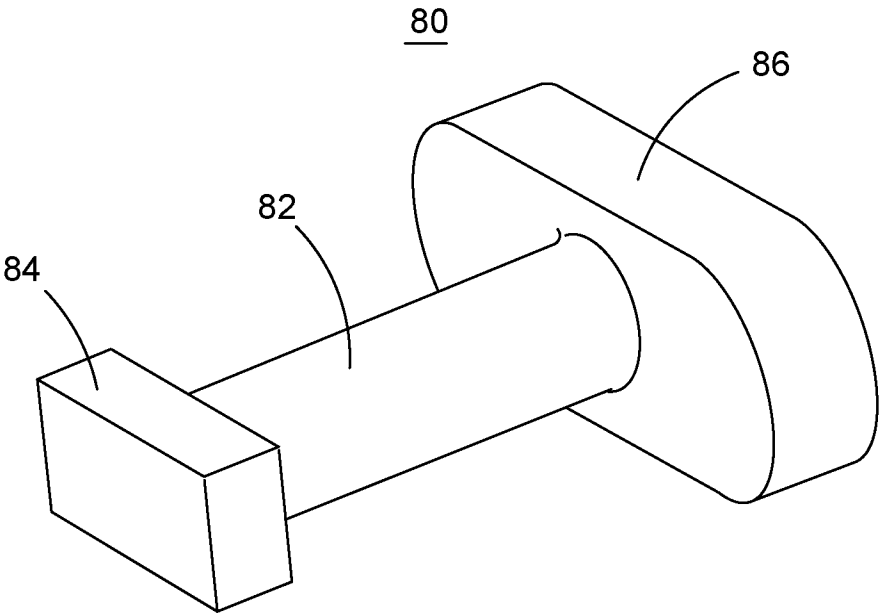
FIG. 5 is an overall view of a double piston to be added to a ram block according to an exemplary embodiment.

The double piston 80 of FIG. 5 has a central portion 82 that connects to two piston sides 84 and 86. The piston side 84 is configured to directly contact the packer 30 while the piston side 86 is configured to contact the fluid existent in the wellbore. In one application, the size of the piston side 86 is larger than the size of the piston side 84 in order to multiply a pressure effect of the wellbore on the packer. The double piston 80 may be made of a metal or composite that can withstand the large pressures and temperatures existing in a wellbore and also the corrosive environment in the wellbore. A shape of the piston side 84 may be made to match a shape of the corresponding packer 30. For example, the piston side 84 may have an elliptical shape. Various other shapes may be used. One or both of the piston sides 84 and 86 may be attached to the central part 82 by various means. Such means may be screws, welding, etc.

Figure 6:
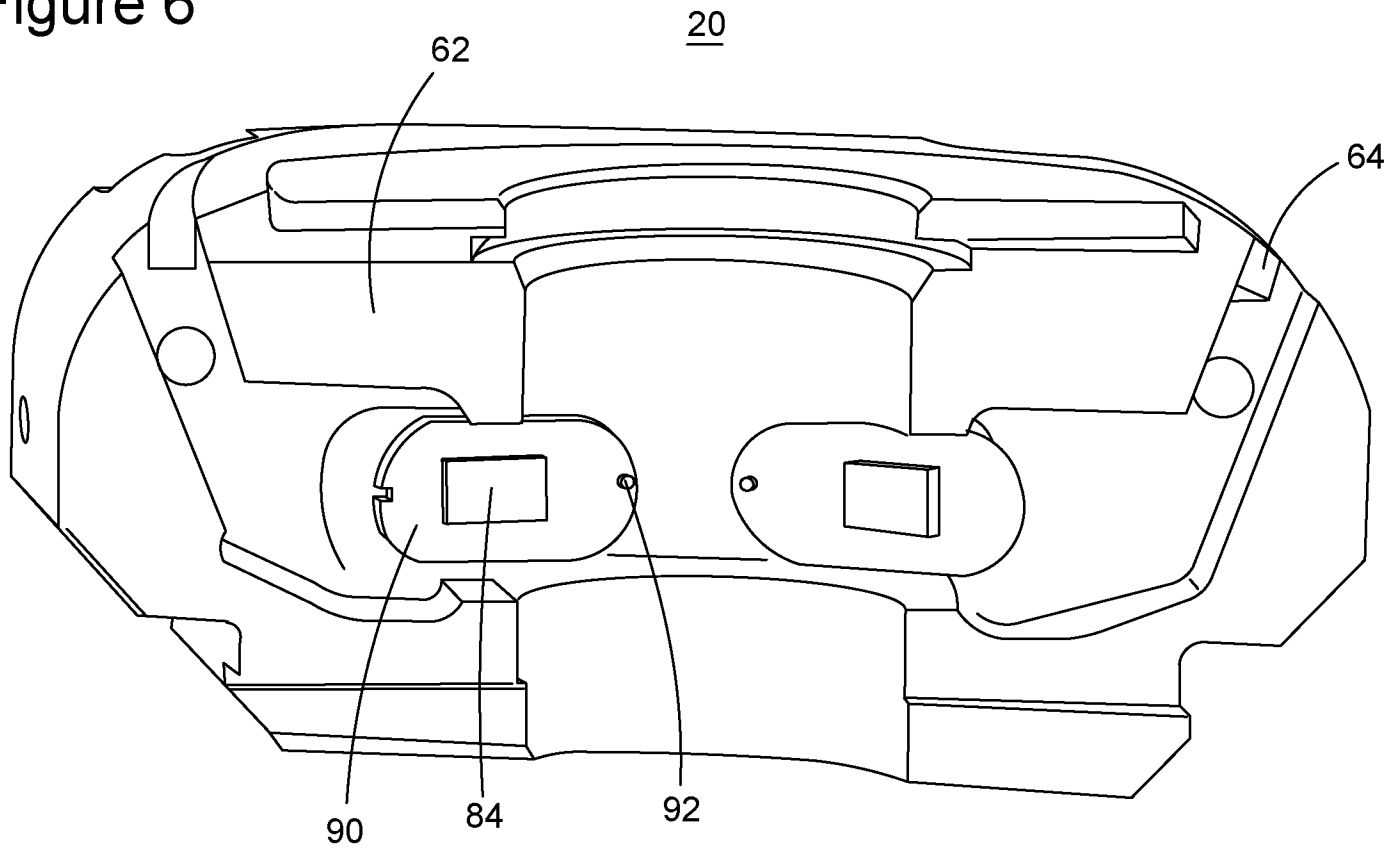
FIG. 6 is a front view of a ram block having metal plates according to an exemplary embodiment.

FIG. 6 shows an embodiment in which the channel 70 has a cross-section larger than a cross-section of the piston side 84. Thus, a plate 90 is bolted with bolts 92 to the ram block 20 and the plate 90 has an opening configured to accommodate the piston side 84 as shown in the figure. Other mechanisms may be envisioned for providing the double piston 80 into the channel 70.

Figure 7:
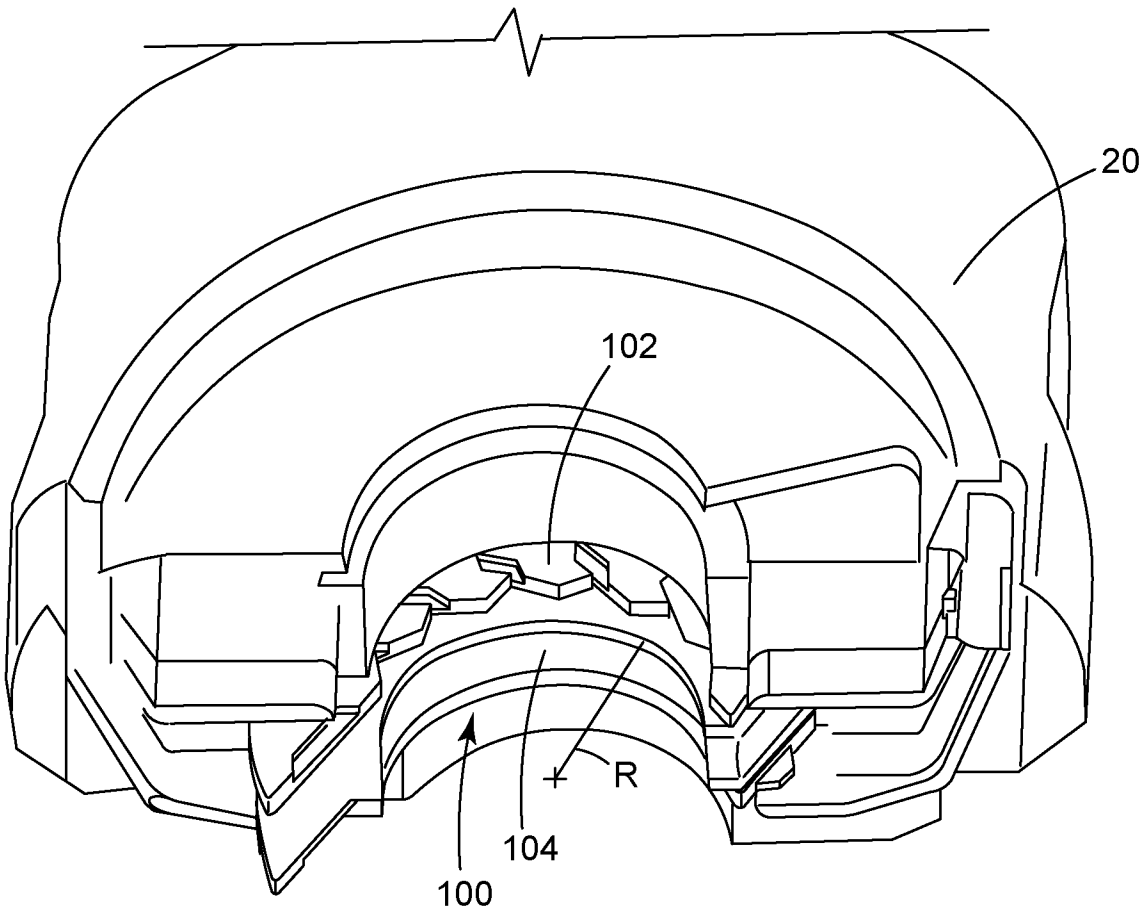
FIG. 7 is an overall view of a packer having metal inserts according to an exemplary embodiment.

The packer may be a conventional one piece elastomer or a more sophisticated one as shown in FIG. 7. The packer 100 shown in FIG. 7 has plural metallic inserts 102 partially provided inside the elastomeric part 104. The profile of the metallic inserts 102 and the flexibility of the elastomeric part 104 make the packer 100 to have a variable radius R. This means that a single packer 100 (variable radius packer) is configured to mate with drill lines (or other tools) having various diameters. For such a packer, the secondary pressure mechanism discussed above is more advantageous than for a conventional one piece elastomer that is designed for a drill line having a given radius. Thus, the sealing of the variable radius packer 100 can be improved by using the channels 70 and double piston 82.

Figure 8:
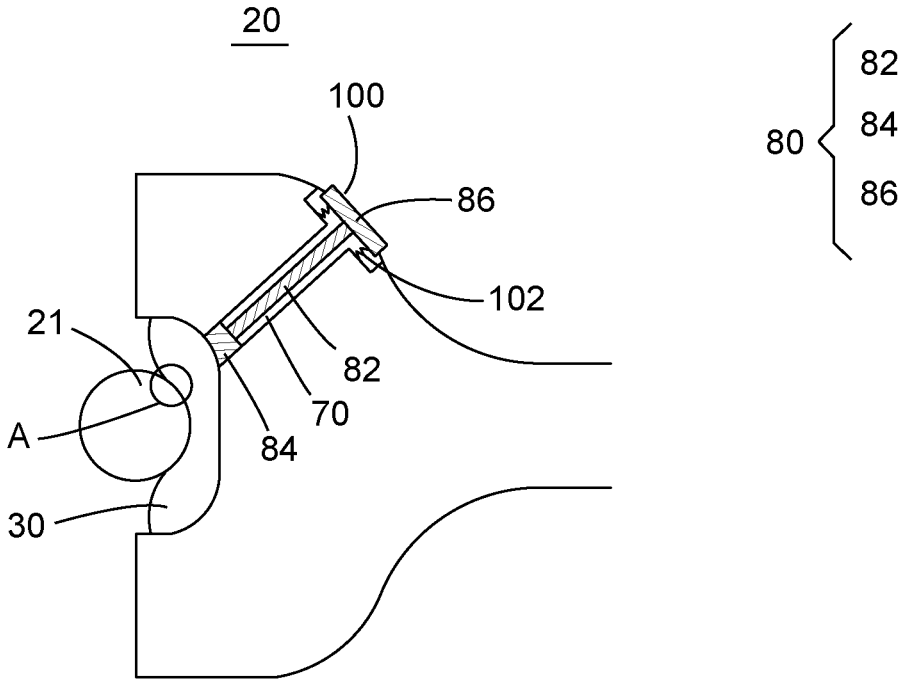
FIG. 8 is a top view of a ram block having a double piston according to an exemplary embodiment.

One advantage provided by one or more of the exemplary embodiments presented above is now discussed. A shape of a face of some of the packers is elliptical. Thus, when the ram blocks are closed to seal a tool, the packers do not completely seal the tool due to this specific shape. This problem is illustrated in FIG. 8. FIG. 8 shows the at least one channel 70 through the ram block 20 and also the components of the double piston 80, i.e., the first piston side 84 facing the packer 30 and the second piston side 86 facing a pressure well. As the packer 30 does not completely seal a region A defined by an interface between the tool 21 and the packer 30, the extra pressure applied by the well fluid at 100 on the second piston side 86 helps to bring the packer 30 closer to the tool 21 in region A as the first piston side 84 directly presses the packer 30 toward the tool 21. Thus, a better seal is achieved by using the double piston 80.

In another application, a spring 102 or equivalent means is provided between the second piston side 86 and the body of the ram block 20 so that only a certain well pressure (above the threshold pressure established by the spring 102) is applied on the packer 30.

Figure 9:
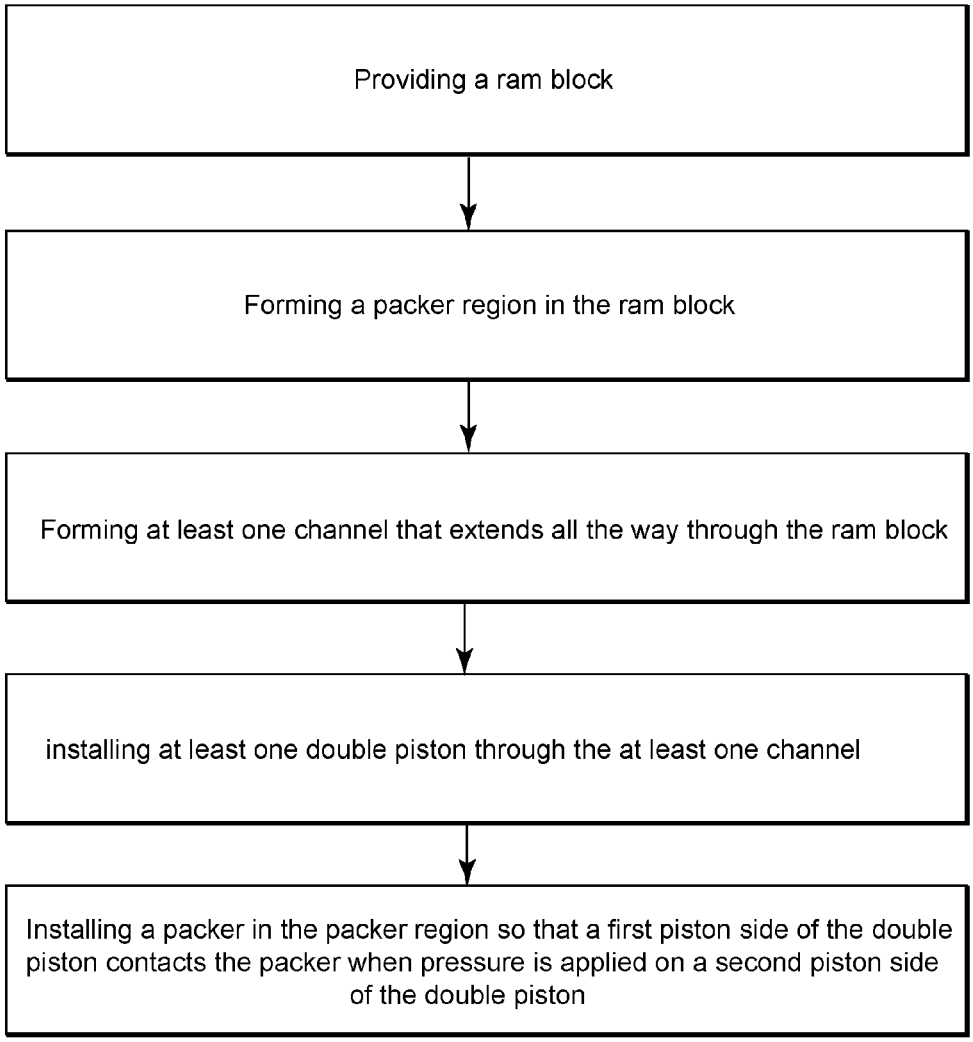
FIG. 9 is a flow chart of a method for assembling a ram block with a double piston according to an exemplary embodiment.

According to an exemplary embodiment illustrated in FIG. 9, there is a method for manufacturing a ram block for a ram blowout preventer. The method includes a step 900 of providing a ram block (20); a step 902 of forming a packer region (64) in the ram block (20); a step 904 of forming at least one channel (70) that extends all the way through the ram block (20); a step 906 of installing at least one double piston (80) through the at least one channel (70); and a step 908 of installing a packer (30) in the packer region (64) so that a first piston side (84) of the double piston (80) contacts the packer (30) when pressure is applied on a second piston side (86) of the double piston (80).

Figure 10:
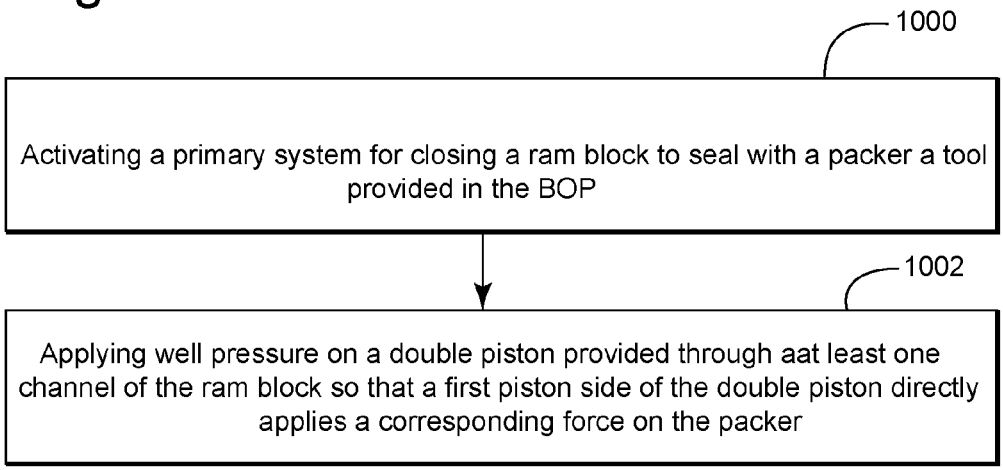
FIG. 10 is a flow chart of a method for operating a BOP with ram blocks having double pistons according to an exemplary embodiment.

According to another exemplary embodiment illustrated in FIG. 10, there is a method of operating a ram blowout preventer for sealing a well. The method includes a step 1000 of activating a primary system (22, 24, 26, 28) for closing a ram block (20) to seal with a packer (30) a tool (21) provided in the BOP (16); and a step 1002 of applying well pressure on a double piston (80) provided through at least one channel (70) of the ram block (20) so that a first piston side (84) of the double piston (80) directly applies a corresponding force on the packer (30).

The disclosed exemplary embodiments provide a ram block, blowout preventer and method for improving a seal between a packer and a tool in a BOP. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

What is claimed is:

1. A ram blowout preventer (BOP) for sealing a well having a wellbore, the ram blowout preventer comprising:

a body having a first chamber extending along a first direction and a second chamber extending along a second direction, substantially perpendicular to the first direction;

a ram block configured to move inside the first chamber, the ram block having a packer region and at least one channel that extends all the way through the ram block;

a packer configured to be provided in the packer region to seal a tool provided inside the second chamber;

at least one double piston provided through the at least one channel, the piston having first and second piston sides connected by a rigid central part, the first piston side for contacting the packer, and the second piston side for contacting fluid in the wellbore; and a metal plate provided on a frontal side of the ram block over the at least one channel, the metal plate having an opening for allowing a part of the double piston to move through the metal plate.

2. The ram BOP of claim 1, wherein the double piston comprises:

the central part is configured to enter inside the at least one channel;

the first piston side is attached to a first end of the central part and configured to apply a force to the packer; and the second piston side is attached to a second end of the central part and configured to contact fluid in from the well.

3. The ram BOP of claim 2, wherein the first piston side has an elliptical shape.

4. The ram BOP of claim 2, wherein a surface of the first piston side that contacts the packer is smaller than a surface of the second piston side so that the well pressure is amplified when applied to the packer.

5. The ram BOP of claim 1, wherein the well pressure is present in the first chamber when the ram blocks are closed.

6. The ram BOP of claim 1, wherein the packer is a single piece of elastomer with no metal inserts.

7. The ram BOP of claim 1, wherein the packer includes plural inserts inserted through a piece of elastomer so that a face of the packer that faces the tool has a variable radius.

8. The ram BOP of claim 1, further comprising:

a closing chamber;

an opening chamber;

a piston provided between the closing chamber and the opening chamber and configured to activate the ram block through a rod, wherein the closing chamber, opening chamber, and piston constitute a primary activation mechanism for the packer and the double piston constitutes a second activation mechanism for the packer.

9. A ram block configured to move inside a first chamber of a ram blowout preventer (BOP), the ram block comprising:

a packer region and at least one channel that extends all the way through the ram block;

a packer configured to be provided in the packer region to seal a tool provided inside a second chamber of the BOP;

at least one double piston provided through the at least one channel, the piston having first and second piston sides connected by a rigid central part, the first piston side for contacting the packer, and the second piston side for contacting fluid in a wellbore; and a metal plate provided on a frontal side of the ram block over the at least one channel, the metal plate having an opening for allowing a part of the double piston to move through the metal plate.

10. The ram block of claim 9, wherein the double piston comprises:

the central part is configured to enter inside the at least one channel;

the first piston side is attached to a first end of the central part and configured to apply a force to the packer; and the second piston side is attached to a second end of the central part and configured to contact fluid in the wellbore.

11. The ram block of claim 10, wherein the first piston side has an elliptical shape.

12. The ram block of claim 10, wherein a surface of the first piston side that contacts the packer is smaller than a surface of the second piston side.

13. The ram block of claim 9, wherein pressure in the wellbore is present in the first chamber when the ram block is closed.

14. The ram block of claim 9, wherein the packer is a single piece of elastomer with no metallic inserts.

15. The ram block of claim 9, wherein the packer includes plural inserts inserted through a piece of elastomer so that a frontal face of the packer that faces a tool has a variable radius.

16. The ram block of claim 9, wherein the packer contacts a tool extending through a BOP when the ram block is closed.

* * * * *